US007297019B2

(12) United States Patent
Landis et al.

(10) Patent No.: US 7,297,019 B2
(45) Date of Patent: Nov. 20, 2007

(54) PLUGGABLE SCREWLESS WIRE CONNECTOR SYSTEM

(75) Inventors: John Michael Landis, Camp Hill, PA (US); David James Fabian, Mount Joy, PA (US)

(73) Assignee: Tyco Electronics Corporation, Middletown, PA (US)

( * ) Notice: Subject to any disclaimer, the term of this patent is extended or adjusted under 35 U.S.C. 154(b) by 40 days.

(21) Appl. No.: 11/071,133

(22) Filed: Mar. 3, 2005

(65) Prior Publication Data

US 2006/0199424 A1 Sep. 7, 2006

(51) Int. Cl.
*H01R 3/00* (2006.01)

(52) U.S. Cl. ..... 439/491; 439/352

(58) Field of Classification Search ..... 439/352, 439/488, 489, 491, 490
See application file for complete search history.

(56) References Cited

U.S. PATENT DOCUMENTS 3,067,403 A * 12/1962 Kulka ..... 439/491
3,945,706 A * 3/1976 Steiner et al. ..... 439/491
4,443,048 A 4/1984 Moist, Jr.
4,544,220 A 10/1985 Aiello et al.
4,564,252 A 1/1986 Kato et al.
4,704,091 A * 11/1987 Owens et al. ..... 439/491
4,787,864 A 11/1988 Hunt, III et al.
5,181,865 A 1/1993 Hayes, Sr.
5,211,583 A * 5/1993 Endo et al. ..... 439/491
5,273,443 A 12/1993 Frantz et al.
5,643,009 A 7/1997 Dinkel et al.
5,741,153 A * 4/1998 Schwer ..... 439/491
5,775,935 A * 7/1998 Barna ..... 439/488
5,924,890 A * 7/1999 Morin et al. ..... 439/490
6,514,098 B2 * 2/2003 Marpoe, Jr. et al. ..... 439/352
6,896,538 B2 * 5/2005 Grubbs ..... 439/352
6,923,675 B2 * 8/2005 Gorin ..... 439/491

OTHER PUBLICATIONS

AMP, Soft Shell Pin and Socket Connectors, Catalog 82181, Revised Jun. 1998, 94 pgs.

* cited by examiner

*Primary Examiner*—Briggitte R. Hammond

(57) ABSTRACT

According to an aspect of the present disclosure, a connector assembly for terminating a plurality of discrete wires and for selective electrical interconnection with a header assembly is provided. The connector assembly includes a front housing defining at least one channel therein; a rear housing operative connected to the front housing, the rear housing including at least one passage formed therein and in operative association with a respective channel of the front housing, each passage terminating a respective discrete wire; and at least one contact disposed at least partially within each channel of the front housing and each corresponding passage of the rear housing. The connector assembly further includes a visual coding system provided on a surface of at least one of the front housing and the rear housing. The visual coding system includes unique indicia for each passage of the rear housing.

11 Claims, 3 Drawing Sheets

PLUGGABLE SCREWLESS WIRE CONNECTOR SYSTEM

BACKGROUND

1. Technical Field

The present disclosure relates to the field of electrical connector assemblies and header assemblies and, more particularly to connector systems including improved connector assemblies facilitating the connection of wires thereto and improved header assemblies configured and dimensioned to mate with multiple connector assemblies simultaneously.

2. Background of Related Art

Pin and socket connectors of the type sold under the tradename MATE-N-LOK®, by AMP Incorporated, a Division of Tyco Electronics Corporation, Harrisburg, Pa., have pin or socket contacts therein which are used to terminate wires coaxially crimped thereto. The contacts are situated in cavities through a housing constructed for mated connection with a complementary housing of another connector or header assembly.

Connector assemblies typically include a housing having cavities therethrough which receive the mating portions of respective contacts, and a retainer with passages therethrough which are assembled over respective wires. The retainer is operatively engaged to the rearward face of the housing to retain the contacts therein. Each wire must be electrically connected to the proper corresponding contact of the connector assembly in order to establish the correct electrical connection and not to short-out the system.

Typically each connector assembly mates with a corresponding header assembly. In other words, for each connector assembly there is a corresponding individual complementary header assembly configured and dimensioned to selectively receive and/or mate with the header assembly. As such, numerous header assemblies are employed to accommodate each and every connector assembly.

The need exists for connector assemblies which provided the user with improved visual indication as to which wire is to be electrically connected to a particular contact.

The need also exists for a header assembly configured and dimensioned to selectively mate with and/or accommodate a multiplicity of connector assemblies simultaneously.

SUMMARY

The present disclosure relates generally to the field of electrical connector assemblies and header assemblies.

According to an aspect of the present disclosure, a connector assembly for terminating a plurality of discrete wires and for selective electrical interconnection with a header assembly is provided. The connector assembly includes a front housing defining at least one channel therein; a rear housing operative connected to the front housing, the rear housing including at least one passage formed therein and in operative association with a respective channel of the front housing, each passage terminating a respective discrete wire; and at least one contact disposed at least partially within each channel of the front housing and each corresponding passage of the rear housing. The connector assembly further includes a visual coding system provided on a surface of at least one of the front housing and the rear housing. The visual coding system includes unique indicia for each passage of the rear housing.

In an embodiment, the indicia is a set of color codes. Desirably, the visual coding system is provided on a rear surface of the rear housing. The visual coding system includes a label including all of the indicia produced thereon. The label may be affixed to the rear surface of the rear housing.

It is envisioned that the passages provided in the rear housing are arranged into an upper row of passages and a lower row of passages. Desirably, the label is affixed between the upper row of passages and the lower row of passages.

The connector assembly may further include a latch arm operatively connected to an upper surface of the rear housing. The latch arm is operatively engagable with a detent provided on a surface of a header assembly.

Desirably, the front housing includes at least one polarization member configured and dimensioned to operatively engage a complementary polarization element provided in a receptacle of the header assembly.

It is envisioned that each contact is a tuning fork-type contact. It is further envisioned that the rear housing includes nine passages formed therein.

According to another aspect of the present disclosure, a header assembly for simultaneously selectively receiving and mating with at least one of a front housing of a connector assembly and contact silos of a plug receptacle housing, is provided. The header assembly includes a body portion having a front surface, a rear surface, a top surface and a bottom surface. The body portion includes a first receptacle formed in the front surface of the body portion. The first receptacle is configured and dimensioned to receive the front housing of the contact assembly therein. The first receptacle includes a plurality of electrical contact leads therein, wherein each contact lead includes an end extending from the rear surface of the body portion. The body portion further includes a second receptacle formed in the front surface of the body portion. The second receptacle is configured and dimensioned to receive the contact silos of the plug receptacle housing therein. The second receptacle includes a plurality of electrical contact leads therein, wherein each contact lead includes an end extending from the rear surface of the body portion.

Desirably, the second receptacle includes a plurality of individual receptacles each configured and dimensioned to receive a corresponding contact silo of a plug receptacle housing.

It is contemplated that at least one of the first receptacle and the second receptacle includes a polarization element configured and dimensioned to operatively engage a complementary polarization member provided on each of the contact assembly and the plug receptacle housing. Desirably, each individual contact receptacle includes a polarization element.

The individual contact receptacles may be arranged in a pair of rows. Desirably, the second receptacle includes at least a pair of individual receptacles arranged one atop the other. The second receptacle desirably includes no more than twenty-four individual receptacles.

In an embodiment, the body portion may include at least one detent formed along the upper surface thereof. Desirably, each detent is configured and dimensioned to selectively engage latching arms of each of the connector assembly and the plug receptacle housing. It is envisioned that the body portion may include a first detent extending from an upper surface thereof and in operative association with the first receptacle; and a second detent extending from an upper surface thereof and in operative association with the second receptacle.

The body portion may include at least one hold-down extending from the bottom surface thereof. Each hold-down is configured and dimensioned to selectively engage an aperture formed in a printed circuit board. Additionally, the electrical contact leads extending from the rear surface of the body portion are electrically engageable with corresponding electrical terminals provided on the printed circuit board.

For a better understanding of the present disclosure and to show how it may be carried into effect, reference will now be made by way of example to the accompanying drawings.

DETAILED DESCRIPTION OF THE DRAWINGS

DETAILED DESCRIPTION OF THE EMBODIMENTS

Figure 1:
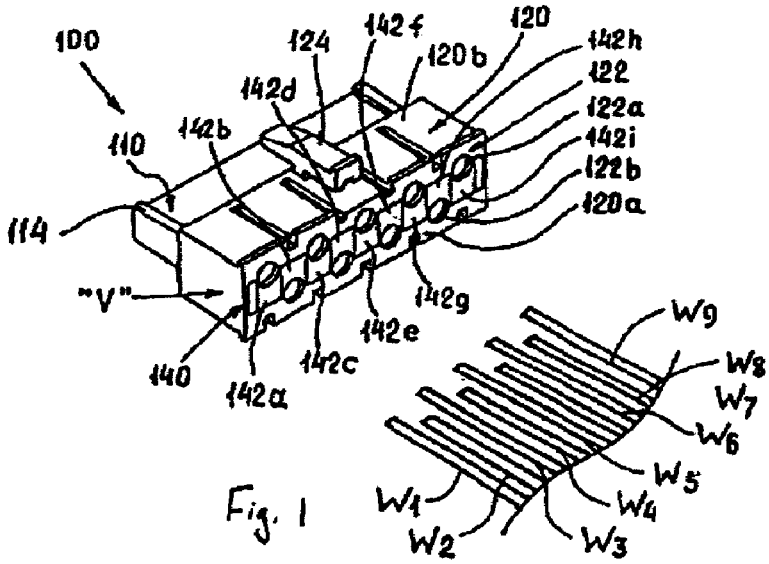
FIG. 1 is a perspective view of a connector assembly according to an embodiment of the present disclosure.
Figure 2:
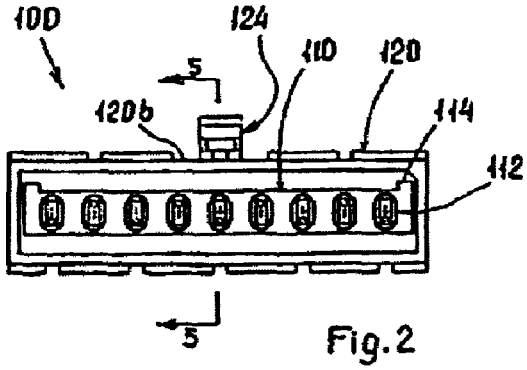
FIG. 2 is a front elevational view of the connector assembly of FIG. 1.
Figure 4:
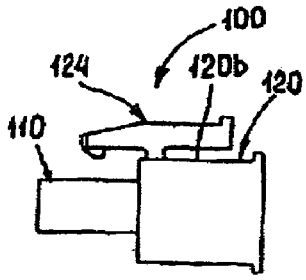
FIG. 4 is a side elevational view of the connector assembly of FIGS. 1-3.

Embodiments of the presently disclosed connector and header assemblies will now be described in detail with reference to the drawing figures wherein like reference numerals identify similar or identical elements. As used herein and as is traditional, the term "distal" refers to that portion which is furthest from the user while the term "proximal" refers to that portion which is closest to the user. In addition, terms such as "above", "below", "forward", "rearward", etc. refer to the orientation of the figures or the direction of components and are simply used for convenience of description.

Referring initially to FIGS. 1-6, a connector assembly, according to an embodiment of the present disclosure, is generally designated as 100. Connector assembly 100 includes a front housing 110, a rear housing 120 configured and dimensioned for operative engagement with front housing 110, and a plurality of contacts 130 operatively supported between front housing 110 and rear housing 120. Desirably, contacts 130 are tuning fork-type contacts, including an integral wire trap arm 130*a* (see FIGS. 5 and 6). Wire trap arm 130*a* of tuning fork-type contacts function to terminate pre-stripped wires to rear housing 120 with just a "poke-in" or insertion contact connection.

Rear housing 120 includes a plurality of passages 122 formed in a rear surface 120*a* thereof. Desirably, passages 122 are arranged in an upper row 122*a* and a lower row 122*b*. While nine total passages 122 are shown, it is contemplated and within the present disclosure that any number of passages 122 may be provided. Desirably, each passage 122 and contact 130 defines a push-in-type wire termination for terminating a respective wire $W_1$-$W_9$ of FIG. 1. Desirably, but not necessary, each wire $W_1$-$W_9$ includes a distinctive outer coating which may be visually identifiable. For example, each wire $W_1$-$W_9$ may be colored differently or have distinctive color markings or the like associated therewith. This coating is removed to a predetermined length for termination.

Front housing 110 includes a plurality of channels 112 arranged to be in operative registration with each passage 122 of rear housing 120 when front housing 110 and rear housing 120 are connected to one another. Front housing 110 further includes at least one polarization member 114 formed on a surface thereof for ensuring proper orientation of connector assembly 100 when being plugged into and/or mated with a header assembly 300. The polarization member 114 ensures that connector assembly 100 is in a proper orientation for mating with header assembly 300 so that the proper electrical connections between connector assembly 100 and header assembly 300 are established.

Connector assembly 100 further includes a latch arm 124 operatively connected to an upper surface 120*b* of rear housing 120. In use, latch arm 124 desirably mates with and/or interlocks with corresponding detents 316 provided on header assembly 300 (see FIGS. 10-12). Latch arm 124 enables connector assembly 100 to be secured to header assembly 300 without the need for screws or the like to ensure that connector assembly 100 does not become dislodged or disconnected from header assembly 300.

Desirably, front and rear housings 110, 120, are fabricated from a thermoplastic type material. Meanwhile, contacts 130 are desirably fabricated from phosphor bronze and/or brass and are preferably coated with tin over nickel plating.

Connector assembly 100 includes a visual coding system "V" provided on rear surface 120*a* of rear housing 120. Desirably, the visual coding system is applied on a label 140 or the like which may be adhered to or otherwise affixed to rear surface 120*a* of rear housing 120. While visual coding system "V" is shown and described as being placed/applied on label 140, it is envisioned and within the scope of the present disclosure for visual coding system "V" to be applied directly onto rear surface 120*a* of rear housing 120. It is further envisioned that visual coding system "V" may be placed anywhere on and/or in front and/or rear housing 110, 120, respectively. Any coding, known in the industry, may be applied to connector 100.

Visual coding system "V" includes a plurality of discrete identifiable and/or recognizable indicia corresponding to each wire which is to be connected or terminated to connector assembly 100. Desirably, each passage 122 includes a unique indicia associated therewith. Preferably, each specific indicium corresponds to an identical or substantially similar color and/or pattern provided with each wire to be terminated at connector assembly 100.

In the embodiment shown in FIGS. 1-6, visual coding system "V" includes nine (9) unique and/or discrete indicia 142*a*-142*i* corresponding, one each, to passages 122. Desirably, each indicia 142*a*-142*i* is provided on label 140 which is affixed to rear surface 120*a* of rear housing 120. It is envisioned that label 140 is affixed to rear surface 120*a* of rear housing 120 at a location between the upper row 122*a* of passages 122 and the lower row 122*b* of passages 122.

Figure 3:
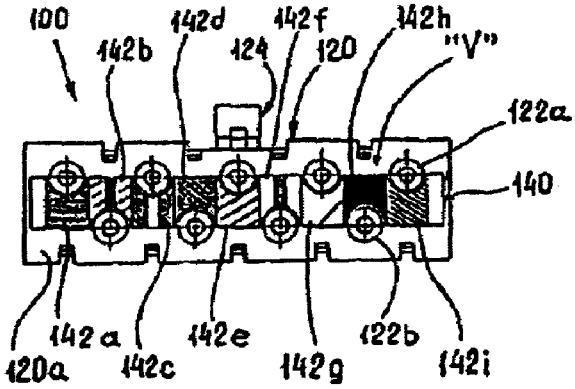
FIG. 3 is a rear elevational view of the connector assembly of FIGS. 1 and 2.
Figure 5:
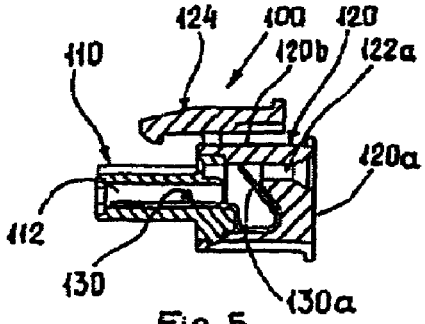
FIG. 5 is a cross-sectional view as taken through 5-5 of the connector assembly of FIGS. 1-4.
Figure 6:
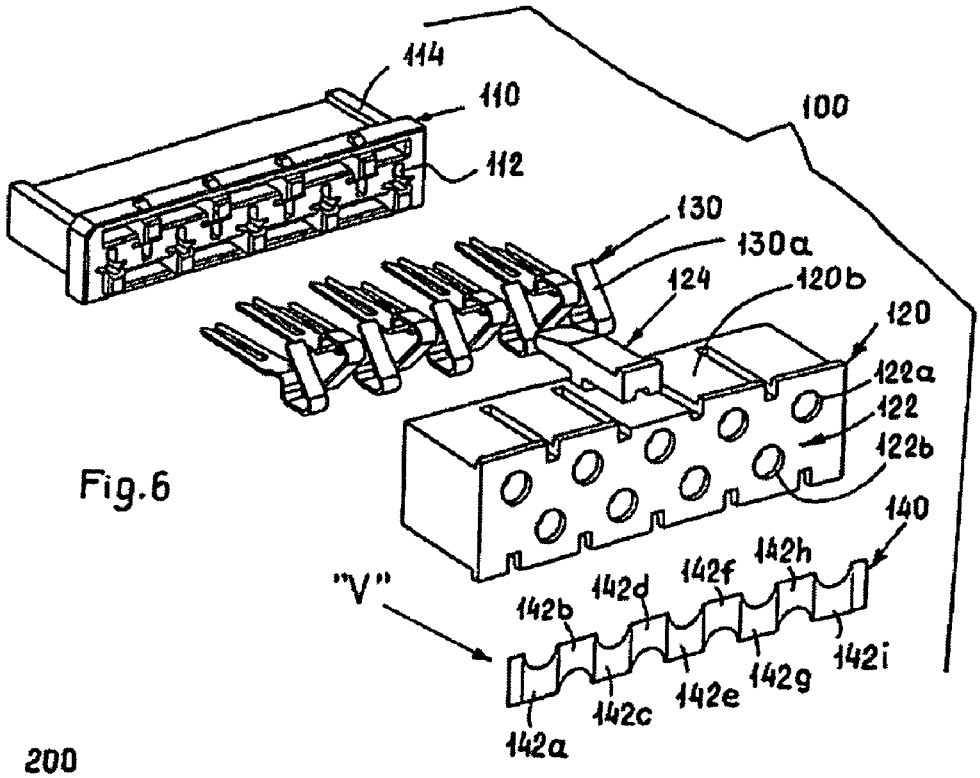
FIG. 6 is a perspective view, with parts separated, of the connector assembly of FIGS. 1-5.

In one embodiment, as seen in FIG. 3, indicia 142*a*-142*i* of label 140 may be represented as follows: indicia 142*a* may be a solid red patch; indicia 142*b* may be a solid yellow patch with a black stripe; indicia 142*c* may be a solid blue patch with a white stripe; indicia 142*d* may be a solid blue patch; indicia 142*e* may be a solid yellow patch; indicia 142*f* may be a solid white patch with a red stripe; indicia 142*g* may be a solid white patch; indicia 142*h* may be a solid black patch; and indicia 142*i* may be a solid orange patch.

It is envisioned that the color coding for each indicia 142*a*-142*i* of the label 140 of visual coding system "V" may correspond to the particular colors of the outer coating of wires $W_1$-$W_9$ which are to be terminated at connector assembly 100. For example, if wire $W_1$ has a red outer coating (the red outer coating not being shown), then wire $W_1$ is to be terminated in the passage 122 having the solid red patch indicia 142*a* associated therewith. In another example, if wire $W_6$ has a white outer coating with a red stripe (the outer coating not being shown), then wire $W_6$ is to be terminated in the passage 122 having the solid white patch with red stripe indicia 142*f* associated therewith. In other words, each wire $W_1$-$W_9$ is matched to a corresponding passage 122 of connector assembly 100 based upon the particular distinctive color of wire $W_1$-$W_9$ and based upon the particular distinctive indicia 142*a*-142*i* associated with each passage 122.

Figure 7:
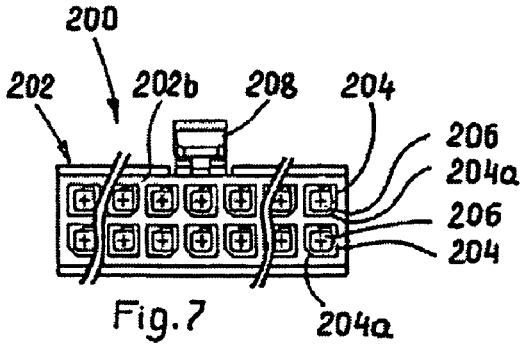
Fig.7 Prior Art
FIG. 7 is a front elevational view of a prior art plug receptacle housing.
Figure 8:
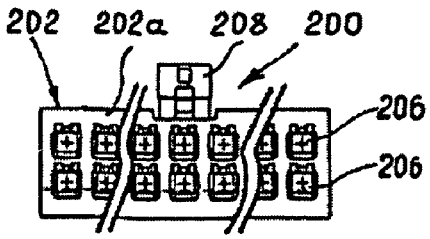
Fig.8 Prior Art
FIG. 8 is a rear elevational view of the prior art plug receptacle housing of FIG. 7.
Figure 9:
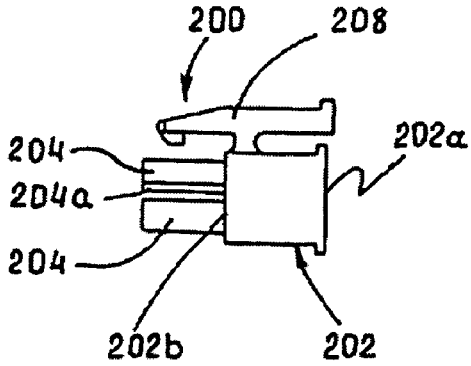
Fig.9 Prior Art
FIG. 9 is a side elevational view of the prior art plug receptacle housing of FIGS. 7 and 8.

Turning now to FIGS. 7-9, a prior art plug receptacle housing is generally designated as 200. Plug receptacle housing 200 includes a main body portion 202 defining a rear surface 202*a*, and a plurality of contact silos 204 extending from a front surface 202*b* of main body portion 202. Plug receptacle housing 200 includes contact receiving passages 206 extending from rear surface 202*a* of main body portion 202 forward through the contact silos 204. The contact silos 204 may be provided with polarization features 204*a* is desired. Contact silos 204 are designed to be received within a second set of receptacles 320 of in header assembly 300

Plug receptacle housing 200 further includes a latch arm 208 which extends forward from main body portion 202. In use, latch arm 208 desirably mates with and/or interlocks with a corresponding detent 326 provided on header assembly 300 (see FIGS. 10-12). Latch arm 208 enables plug receptacle housing 200 to be secured to header assembly 300 without the need for screws or the like to ensure that plug receptacle housing 200 does not become dislodged or disconnected from header assembly 300.

Plug receptacle housing 200 may include anywhere from two to twenty-four contact silos 204 extending from main body portion 202, wherein the contact silos 204 are arranged in a pair of rows.

Connectors using plug receptacle housings 200 are of the type sold under the tradename MATE-N-LOK®, by AMP Incorporated, a Division of Tyco Electronics Corporation, Harrisburg, Pa.

Figure 10:
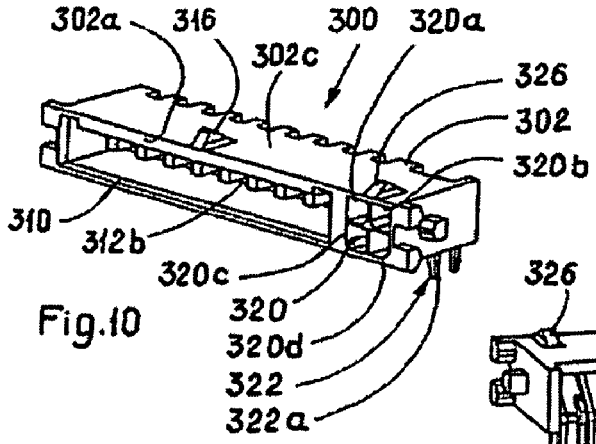
FIG. 10 is a front perspective view of a header assembly according to an embodiment of the present disclosure for simultaneously accommodating the connector assembly of FIGS. 1-6 and the plug receptacle housing of FIGS. 7-9.
Figure 11:
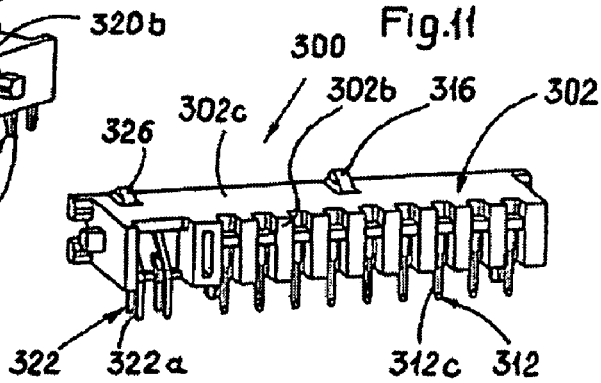
FIG. 11 is a rear perspective view of the header assembly of FIG. 10.
Figure 12:
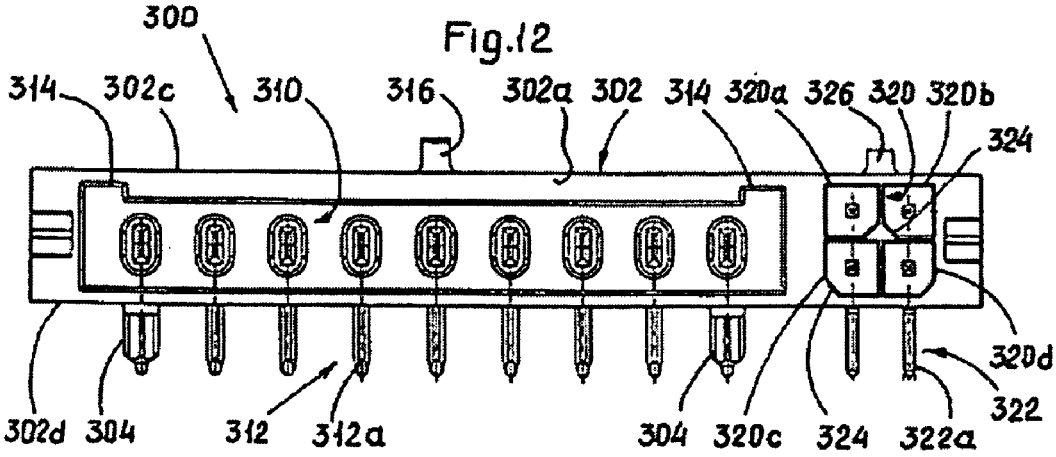
FIG. 12 is a front elevational view of the header assembly of FIGS. 10 and 11.

Turning now to FIGS. 10-12, a header assembly, according to an embodiment of the present disclosure, is generally designated as 300. Header assembly 300 is configured and dimensioned to simultaneously selectively receive and mate with connector assembly 100 and/or plug receptacle housing 200.

Header assembly 300 includes a body portion or housing 302 defining a first receptacle 310 and a second receptacle 320 formed in a front surface 302*a* thereof. While first receptacle 310 and second receptacle 320 are shown as being located adjacent to one another in FIGS. 10 and 12, it is envisioned and within the scope of the present disclosure for first receptacle 310 and second receptacle 320 to be located in any relative position to one another without departing from the scope and spirit of the present disclosure.

Desirably, first receptacle 310 is configured and dimensioned to selectively receive and/or mate with connector assembly 100 and establish an electrical connection therewith. Additionally, second receptacle 320 is configured and dimensioned to selectively receive and/or mate with plug receptacle housing 200 and establish an electrical connection therewith.

As seen in FIGS. 10-12, first receptacle 310 includes a plurality of electrical contact leads 312 operatively associated therewith and arranged to electrically engage contacts 130 of connector housing 100. Electrical contact leads 312 include a first end (312*b*) for electrical connection with contacts 130 of connector housing 100, and a second end 312*a* extending from a rear surface 302*b* of housing 302 for electrical connection with a printed circuit board "P" (see FIG. 13).

First receptacle 310 of header assembly 300 is provided with at least one polarization element 314 which complements polarization element 114 of connector assembly 100. Header assembly 300 further includes a first detent 316 extending from an upper surface 302*c* of housing 302. First detent 316 is positioned on housing 302 at a location so as to selectively engage latch arm 124 (see FIGS. 1-6) of connector assembly 100.

As seen in FIGS. 10-12, second receptacle 320 includes at least two, preferably a plurality of individual receptacles, each configured and dimensioned to selectively receive a corresponding contact silo 204 of plug receptacle housing 200. In the embodiment shown in FIGS. 10-12, second receptacle 320 includes four (4) individual receptacles 320*a*-320*d*. While four (4) individual receptacles 320*a*-320*d* are shown and described, it is envisioned and within the scope of the present disclosure that any number of individual receptacles may be provided, such as for example, anywhere from two (2) individual receptacles to at least twenty-four (24) individual receptacles, without departing from the spirit and the scope of the present disclosure. Desirably, the number of individual receptacles corresponds to the number of contact silos 204 of plug receptacle housing 200 intended to be mated to header assembly 300.

Header assembly 300 further includes a plurality of electrical contact leads 322 operatively associated with each individual receptacle 320*a*-320*d*. Electrical contact leads 322 are desirably arranged to electrically engage electrical contacts (not shown) of plug receptacle housing 200. Electrical contact leads 322 include a first end (not shown) for electrical connection with the electrical contacts (not shown) of plug receptacle housing 200, and a second end 322*a* extending from rear surface 302*b* of housing 302 for electrical connection with printed circuit board "P" (see FIG. 13).

Each individual receptacle of the second receptacle 320 of header assembly 300 is provided with at least one polarization element 324 which complements polarization element 204*a* of plug receptacle housing 200. Header assembly 300 further includes a second detent 326 extending from upper surface 302*c* of housing 302. Second detent 326 is positioned on housing 302 at a location so as to selectively engage latch arm 208 (see FIGS. 7-9) of plug receptacle housing 200.

First and second detents 316, 326 function to selectively engage latch arm 124 of connector assembly 100 and latch arm 208 of plug receptacle housing 200, respectively. As mentioned above, detents 316, 326 and latch arms 124 and 208 function to operatively engage one another and respectfully prevent connector assembly 100 and/or plug receptacle housing 200 from becoming dislodged and/or disconnected from header assembly 300.

While header assembly 300 is shown as having a second receptacle 320 configured and dimensioned to selectively engage and/or mate with a plug receptacle housing 200 including four (4) contact silos 204 arranging in two rows of two, it is envisioned and within the scope of the present disclosure for header assembly 300 to include a second receptacle 320 configured and dimensioned to receive a plug receptacle housing having any number of contact silos 204 without departing from the scope and or spirit of the present disclosure.

Desirably, second receptacle 320 of header assembly 300 is configured and dimensioned to selectively engage and/or mate with plug receptacle housings 200 of the type sold under the tradename MATE-N-LOK®.

As seen in FIG. 12, header assembly 300 includes at least one, preferably a pair, of hold-downs 304 extending from a bottom surface 302*d* thereof. Hold-downs 304 are configured and dimensioned to snap-fit connect header assembly 300 to printed circuit board "P".

Figure 13:
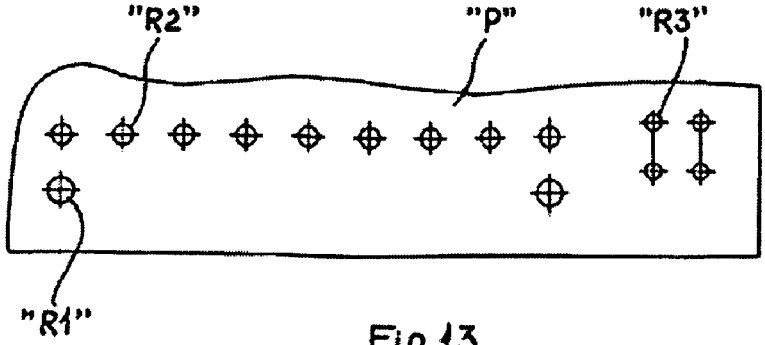
FIG. 13 is a plan view of a printed circuit board illustrating a layout for receiving hold-downs and contact leads extending from the header assembly of FIGS. 10-12.

As seen in FIG. 13, a preferred layout for a printed circuit board "P" for operatively engaging with header assembly 300 is shown. Printed circuit board "P" includes at least one, preferably a pair of, mounting apertures "R1" configured and dimensioned to receive hold-downs 304 of header assembly 300. Printed circuit board "P" further includes a row of apertures "R2" formed therein for receiving and electrically engaging the second end 312*a* of electrical contact leads 312 extending from first receptacle 310. Printed circuit board "P" additionally includes a set of apertures "R3" configured and dimensioned to receive and electrically engage the second end 322*a* of electrical contacts 322 extending from second receptacle 320.

It is to be understood that the foregoing description is merely a disclosure of particular embodiments and is in no way intended to limit the scope of the invention. Other possible modifications will be apparent to those skilled in the art and all modifications will be apparent to those in the art and all modifications are to be defined by the following claims.

What is claimed is:

1. A connector assembly terminating a one wire or a plurality of discrete wires to a header assembly, the connector assembly comprising:

a front housing defining a first set of channels each having at least one passage to accept a separable contact, the front housing detachably connected to a portion of the header assembly having at least a first and a second receptacle, the first receptacle having a second set of channels and the second receptacle having a third set of channels, the second set of channels configured to provide leads to the first set of channels of the front housing of the connector assembly, wherein the second set of channels has (i) a different physical configuration and (ii) a different type of polarization element than the third set of channels;

a rear housing operatively connected to the front housing, the rear housing including at least one passage formed therein and in operative association with a respective channel of the front housing, each passage terminating a respective discrete wire;

at least one contact disposed at least partially within each channel of the front housing and each corresponding passage of the rear housing; and a visual coding system provided on a surface of one of the front housing and the rear housing, the visual coding system including a unique indicia for each passage of the rear housing.

2. The connector assembly according to claim 1, wherein the indicia is a set of color codes.

3. The connector assembly according to claim 1, further comprising a latch arm operatively connected to an upper surface of the rear housing, wherein the latch arm operatively engages a detent provided on a surface of a header assembly.

4. The connector assembly according to claim 1, wherein each contact is a tuning fork-type contact to accept the leads on one end thereof and wire trap arm on another end thereof.

5. The connector assembly according to claim 1, wherein the rear housing includes nine passages formed therein.

6. The connector assembly according to claim 1, wherein the at least one passage of the rear housing is angularly offset with the respective channel of the front housing.

7. The connector assembly according to claim 1, wherein the visual coding system is provided on a rear surface of the rear housing.

8. The connector assembly according to claim 7, wherein the visual coding system includes a label including all of the indicia produced thereon, wherein the label is affixed to the rear surface of the rear housing.

9. The connector assembly according to claim 8, wherein the passages provided in the rear housing are arranged into an upper row of passages and a lower row of passages.

10. The connector assembly according to claim 9, wherein the label is affixed between the upper row of passages and the lower row of passages.

11. A connector assembly terminating a one wire or a plurality of discrete wires to a header assembly, the connector assembly comprising:

a front housing defining a first set of channels each having at least one passage to accept a separable contact, the front housing detachably connected to a portion of the header assembly having at least a first and a second receptacle, the first receptacle having a second set of channels and the second receptacle having a third set of channels, the second set of channels configured to provide leads to the first set of channels of the front housing of the connector assembly, wherein the second set of channels has (i) a different physical configuration and (ii) a different type of polarization element than the third set of channels;

a rear housing operative connected to the front housing, the rear housing including at least one passage formed therein and in operative association with a respective channel of the front housing, each passage terminating a respective discrete wire, wherein the at least one passage of the rear housing is angularly offset with the respective channel of the front housing;

at least one contact disposed at least partially within each channel of the front housing and each corresponding passage of the rear housing;

a visual coding system provided on a surface of one of the front housing and the rear housing, the visual coding system including a unique indicia for each passage of the rear housing.

* * * * *